US005173178A

United States Patent [19]

Kawashima et al.

[11] Patent Number: 5,173,178

[45] Date of Patent: Dec. 22, 1992

[54] WATER PURIFYING APPARATUS WITH TIMED DISCHARGE AFTER NON-USE PERIODS

[75] Inventors: Eiichi Kawashima, Sayama; Kyohei Shinozaki, Urawa, all of Japan

[73] Assignee: Osaki Electric Co., Ltd., Tokyo, Japan

[21] Appl. No.: 764,739

[22] Filed: Sep. 24, 1991

[51] Int. Cl.[5] ..... B01D 35/157

[52] U.S. Cl. ..... 210/85; 210/89; 210/94; 210/138; 137/801; 251/129.04

[58] Field of Search ..... 4/623; 137/624.11, 624.13, 137/624.15, 801; 210/85, 138, 143, 282, 94, 95, 87-89, 97; 222/638; 251/129.04, 129.01

[56] References Cited

U.S. PATENT DOCUMENTS

| | | | |
|---|---|---|---|
| 3,505,692 | 4/1970 | Forbes | 4/623 |
| 4,520,516 | 6/1985 | Parsons | 4/623 |
| 4,823,414 | 4/1989 | Piersimoni et al. | 137/624.11 |
| 4,893,039 | 6/1989 | Parsons et al. | 210/143 |
| 4,925,551 | 5/1990 | Lipshultz et al. | 210/143 |
| 5,063,955 | 11/1991 | Sakakibara | 4/623 |

FOREIGN PATENT DOCUMENTS

| | | | |
|---|---|---|---|
| 101589 | 5/1988 | Japan | 137/801 |
| 3270589 | 11/1988 | Japan | 210/138 |

*Primary Examiner*—Robert A. Dawson
*Assistant Examiner*—Joseph Drodge
*Attorney, Agent, or Firm*—Sughrue, Mion, Zinn, Macpeak & Seas

[57] ABSTRACT

An under-sink type water purifier with a water-tap portion connected to a purified-water outlet of the purifier having a sensor for sensing an object to issue a signal, and a solenoid valve for starting and stopping the discharge of purified water from the water-tap portion in response to the signal. The apparatus is characterized by a control circuit for opening and closing the valve in response to the signal. The circuit is provided with at least one of a first timer for opening the valve at every preset time for a short time, and a second timer for opening the valve for a short time to permit the water-tap portion to discharge the purified water therefrom when the purified water remains confined in the purifier for a predetermined period of time. These timers are selectively used in operation.

9 Claims, 5 Drawing Sheets

WATER PURIFYING APPARATUS WITH TIMED DISCHARGE AFTER NON-USE PERIODS

BACKGROUND OF THE INVENTION

1. Field of the Invention

The present invention relates to a water purifying apparatus provided with an under-sink type water purifier, and more particularly to one capable of delaying bacterial development in tap water confined in a container of the water purifier thereof in use.

2. Description of the Prior Art

Heretofore, in order to eliminate residual chlorine (which is used for disinfecting) and odor materials from tap water, it has been known to use a water purifying apparatus in home kitchens and restaurants. The water purifying apparatus employs a water purifier provided with a water-flow type container in which suitable absorbents such as activated charcoal and the like are contained. The container of the water purifier has a water-inlet and a water-outlet port which are connected with a water-supply pipe and a water-discharge pipe, respectively. Further, in some cases, the water purifier has additional filters such as microporous filters or ultrafilters for removing bacteria from tap water. The water purifying apparatus, which has its water-inlet port connected with a tap-water distributing pipe, eliminates residual chlorine and odor materials dissolved in tap water, and discharges a purified water from its water-outlet port.

Of these water purifying apparatuses, some apparatuses have their water purifier mounted in cabinets under sinks of kitchens. Each of these so-called under-sink type water purifier has its water-tap portion only disposed above the sink, the water-tap portion being connected with a main body of the water purifier through pipes to enable the water-tap portion to permit and prevent alternately the discharge of the purified water therefrom. Starting-stopping of discharge of the purified water from the water-tap portion is directly controlled by operating a handle of the water tap, or remotely controlled by the use of a suitable remote control means. Incidentally, since the users of today prefer high-grade products, it increases the tendency of the water-tap portion to be remotely controlled.

In the above remote-control means, a contactless type object sensor (which utilizes infrared rays, ultrasonic waves or like waves for detecting an object) is provided in the water-tap portion of the water purifying apparatus. In operation, only when the object, for example such as a user's hand is near the object sensor, the sensor issues a detection signal for permitting the water-tap portion to discharge the purified water therefrom. More particularly, the detection signal issued from the object sensor is transmitted to a solenoid valve (which is disposed under the sink) to cause the valve to be opened, so that the purified water passes through the valve and is discharged from the water-tap portion of the water purifier.

As for the object sensor of the remote-control means, there are two types of the sensors. One is a set/reset type, and the other is a reaction type. In the water purifier provided with the set/reset type object sensor, the water-tap portion alternately starts and stops the discharge of the purified water therefrom each time the user's hand is near the sensor. On the other hand, in the water purifier provided with the reaction type object sensor, the water-tap portion continuously discharges the purified water as long as the user's hand is near the sensor.

Further, in the water purifier provided with the set/reset type object sensor, a sensible area of the sensor is not formed in front of the sink, but formed in an area adjacent to a right or a left side of the sink so as to prevent the sensor from issuing a signal when other objects such as a cup and the like is near the sensor. On the other hand, in the water purifier provided with the reaction type object sensor, a sensible area thereof is formed in front of the sink to permit the water-tap portion to discharge the purified water only when the object such as the user's hand the like is near the sensor.

Further, in the water purifying apparatus, in place of the above contactless type object sensor, it is possible to use a push-button type mechanical switch which issues a detection signal when the user pushes a push button of the switch.

In addition, in the water purifying apparatus, in place of the object sensor mounted on the water tap, it is possible to mount a mechanical foot-operated switch in the vicinity of a floor near the kitchen cabinet.

The use of the above mechanical push-button type and the mechanical foot-operated switch is well known.

However, in any type of these conventional water purifying apparatus, there is a fear that bacterial development is enhanced in the tap water (which is confined in the container of the water purifier) to such an extent that the confined water can not be used as a drinking water when the purifier is not used for a long period of time, because the residual chlorine (which is used for disinfecting and dissolved in the confined water) is substantially completely absorbed in the absorbents of the purifier.

SUMMARY OF THE INVENTION

Under such circumstances, the present invention was made. Consequently, it is an object of the present invention to provide a water purifying apparatus for considerably delaying bacterial development in tap water confined in the apparatus.

According to a first aspect of the present invention, the above object of the present invention is accomplished by providing:

In a water purifying apparatus comprising: an under-sink type water purifier; a water-tap portion connected with a purified-water outlet of the water purifier; an object sensor for sensing an object to issue a detection signal; and a solenoid valve for starting and stopping the discharge of purified water from the water tap portion in response to the detection signal issued from the object sensor;

the improvement wherein:

the water purifying apparatus further comprises a control circuit for opening and closing the solenoid valve in response to the detection signal issued from the object sensor; and the control circuit is provided with a timer means for opening the solenoid valve at every preset time for a short time.

According to a second aspect of the present invention, the above object of the present invention is accomplished by providing:

In a water purifying apparatus comprising: an under-sink type water purified; a water-tap portion connected with a purified-water outlet of the water purifier; an object sensor for sensing an object to issue a detection signal; and a solenoid valve for starting and stopping the discharge of purified water from the water tap portion in response to the detection signal issued from the object sensor;

the improvement wherein:

the water purifying apparatus further comprises a control circuit for opening and closing the solenoid valve in response to the detection signal issued from the object sensor; and the control circuit is provided with a timer means for opening the solenoid valve for a short time to permit the water-tap portion to discharge the purified water therefrom when the purified water remains confined in the water purifier for a predetermined period of time.

According to a third aspect of the present invention, the above object of the present invention is accomplished by providing:

In a water purifying apparatus comprising: an under-sink type water purifier; a water-tap portion connected with a purified-water outlet of the water purifier; an object sensor for sensing an object to issue a detection signal; and a solenoid valve for starting and stopping the discharge of purified water from the water tap portion in response to the detection signal issued from the object sensor;

the improvement wherein:

the water purifying apparatus further comprises a control circuit for opening and closing the solenoid valve in response to the detection signal issued from the object sensor;

the control circuit is provided with: a first timer means for opening the solenoid valve at every preset time for a short time; and a second timer means for opening the solenoid valve for a short time to permit the water-tap portion to discharge the purified water therefrom when the purified water remains confined in the water purifier for a predetermined period of time; and the first and the second timer means is selectively used in operation.

According to a fourth aspect of the present invention, the above object of the present invention is accomplished by providing:

The water purifying apparatus as set forth in any one of the first to the third aspects of the present invention, wherein:

a battery power pack is used as a power supply for supplying electric current to the control circuit, the object sensor, the solenoid valve and the timer means.

According to a fifth aspect of the present invention, the above object of the present invention is accomplished by providing:

The water purifying apparatus as set forth in the fourth aspect of the present invention, wherein:

the solenoid valve is of a self-holding type.

The above object, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, the present invention will be described in detail with reference to the accompanying drawings.

Figure 1:
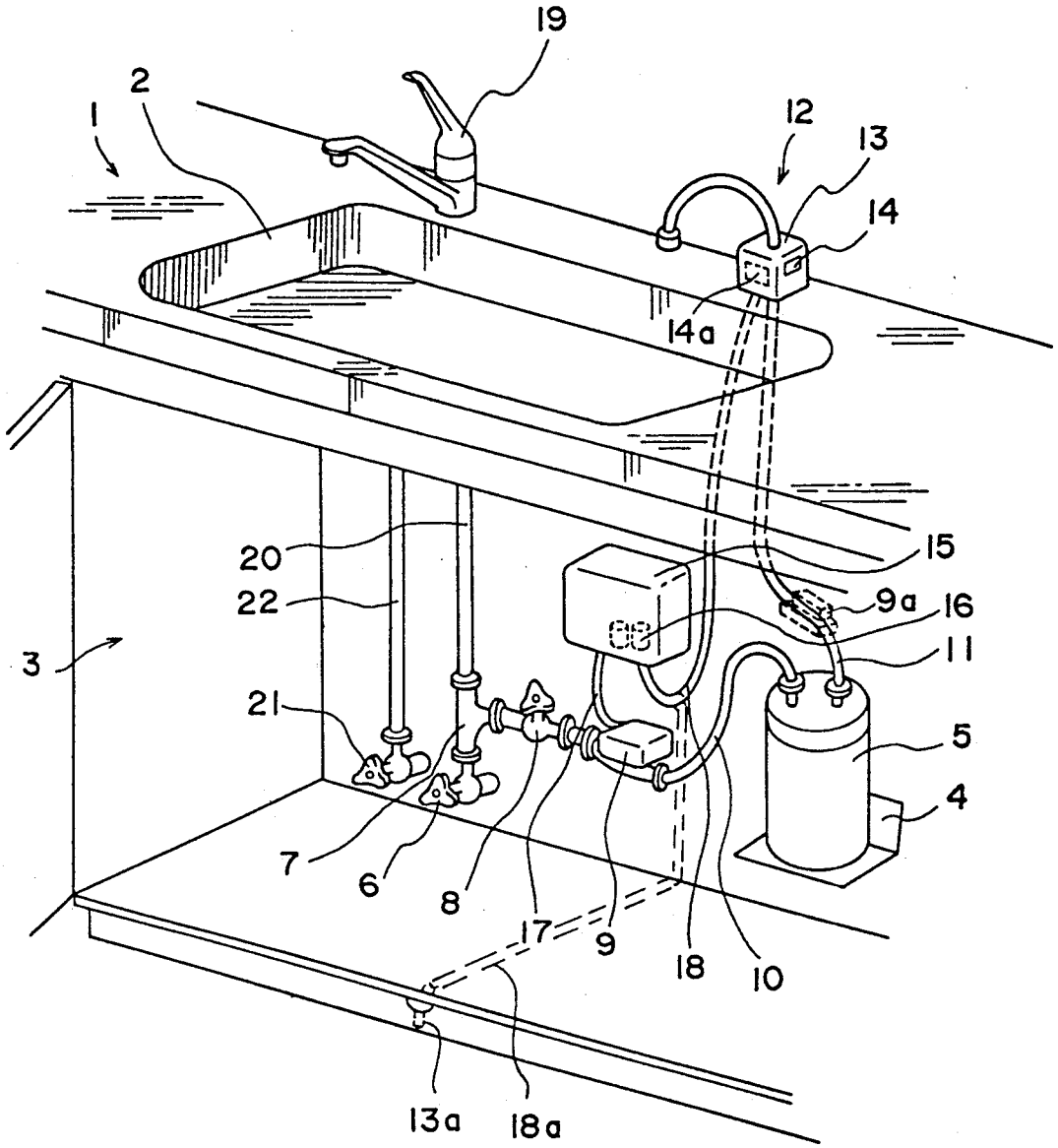
FIG. 1 is a perspective view of a sink of a kitchen in which the water purifying apparatus of the present invention is installed.

As shown in FIG. 1, a water purifying apparatus of the present invention is provided with an under-sink type water purifier 5 which is mounted on a bracket 4 fixed to a wall of a cabinet 3 disposed under a sink 2 in a kitchen unit 1. On the other hand, tap water is supplied to the water purifier 5 through an angle valve 6, a T-tube joint 7, a stop cock 8, a self-holding type solenoid valve 9 and a flexible pipe 10. The water purifier 5 receives tap water and purifies it to produce therein a purified water (which is discharged from an outlet port of the purifier 5 and supplied to a water-tap portion 12 through a flexible pipe 11) to make it possible that the purified water is supplied to a user from the water-tap portion 12 as needs require.

In the water purifying apparatus of the present invention shown in FIG. 1, an object sensor 13 for sensing or detecting an object is incorporated in the water-tap portion 12 of the purifier 5. A sensor window 14 for sensing the object is formed in a side surface of the object sensor 13 as shown in FIG. 1, so that the sensor 13 issues a detection signal when the object is near the sensor window 14. It is also possible to form the sensor window in a front surface of the sensor 13. The sensor window formed in the front surface of the sensor 13 is denoted by the reference numeral 14*a*, while illustrated in dotted line in FIG. 1. Preferably, the object sensor 13 is of a contactless type utilizing infrared rays, ultrasonic waves or like other suitable waves. In operation, for example, the object sensor 13 issues a high-level signal or ON signal when the object is near the sensor window 14 or 14*a*, and issues a low-level signal or OFF signal when no object is near the sensor window 14 or 14*a*.

As is clear from FIG. 1, a control box 15 of the water purifying apparatus of the present invention is fixedly mounted in the cabinet 3 under the sink 2, in which box 15 are housed a control circuit 30 (shown in FIG. 2) and a battery power pack 16 (shown in FIG. 2) for supplying electric power to the circuit 30. Both of the battery power pack 16 and the control circuit 30 housed in the control box 15 are electrically connected with a solenoid valve 9 through a cable 17, while electrically connected with the object sensor 13 through a cable 18.

In place of the use of the object sensor mounted on the water tap portion, as shown in the drawings, it is possible to use a suitable contact type mechanical sensor 13*a* such as a foot-operated switch mounted in the vicinity of a floor near the kitchen cabinet 3. In this case, the control box 15 is connected with the mechanical sensor 13*a* through a cable 18*a* shown in dotted line.

Incidentally, in the above embodiment of the water purifying apparatus of the present invention shown in FIG. 1, the solenoid valve 9 is mounted in the flexible pipe 10 through which tap water is supplied to the water purifier 5. However, it is also possible to mount the solenoid valve in the flexible pipe 11 (which extends from the outlet port of the water purifier 5), as shown in dotted line and denoted by the reference numeral 9*a* in FIG. 1.

It is also possible for the control circuit 30 of the water purifying apparatus of the present invention to use a commercial AC power source in place of the battery power pack 16. However, the use of the battery power pack 16 in the apparatus of the present invention is advantageous in installing the apparatus in the kitchen, since any additional wiring work is not required in such installation when the battery power pack 16 is used as an electrical power source for the apparatus.

Further, the use of the battery power pack 16 is advantageous in preventing the user from receiving an electric shock due to possible electric leakage in the apparatus. In addition, the battery power pack 16 can keep the apparatus alive even when the supply of a commercial AC electricity is interrupted by accident. Since the sink 2 is always subjected to water in the kitchen, it is particularly advantageous for the apparatus of the present invention to prevent the user from receiving the electric shock due to the possible electric leakage in the apparatus. The battery power pack 16 may be any of a dry type and/or a storage type.

In case that the battery power pack 16 is used an electric power source for the water purifying apparatus of the present invention, it is necessary for the user to replace the battery power pack 16 with a new one or to recharge it after the present battery power pack 16 is exhausted in operation. In the water purifying apparatus of the present invention, much of electric power supplied from the battery power pack 16 is consumed by the solenoid valve 9. Consequently, if the power consumption in the solenoid valve 9 is reduced, it is possible for the user to enjoy a long service life of the apparatus of the present invention. Namely, in the present invention, the solenoid valve 9 or 9*a* is preferably of a self-holding type since the power consumption of this type is extremely low. However, it is also possible for the apparatus of the present invention to use any other type of solenoid valve such as one requiring continuous electric current supply for keeping itself opened or closed.

There are some solenoid valves of this type for industrial use, for example such as ones called "SKINNER VALVES" of a series of "V5 solenoid valves" produced by Yamatake Honeywell Inc. and ones of magnetic latch type of a series of "R solenoid valves" produced by the same Inc. These solenoid valves of self-holding type use magnetic materials (which have large residual magnetism) as iron cores for their solenoids.

Each of the self-holding type solenoid valves described above operates as follows: namely, when electric current is supplied to the solenoid of the valve, a valve stem of the valve is attracted by the thus energized solenoid to open or close the valve. Under such circumstances, the valve stem remains attracted to the solenoid under the influence of the residual magnetism of the iron core of the solenoid even though the electric current supplied to the solenoid is shut off. Consequently, in the self-holding type solenoid valve, since only one short-duration pulse-like electric current supplied to the solenoid suffices to open or close the valve, it is possible for the apparatus of the present invention (which uses the self-holding type solenoid valve) to considerably reduce its power consumption. In case that it is necessary to return the solenoid valve to its initial condition, only one short-duration pulse-like electric current supplied to the solenoid in reverse direction to the above suffices to return the valve to its initial condition. More particularly, in the self-holding solenoid valve, in order to open or close the valve initially, a duration of such pulse-like electric current, i.e., DC-current pulse must be substantially within a range of from 30 to 50 milliseconds. On the other hand, in order to return the valve, the duration of the DC current pulse must be substantially within a range of from 30 to 100 milliseconds.

In the embodiment of the present invention shown in FIG. 1, the sink 2 is generally provided with a conventional-type mixing tap 19 for mixing cold water with hot water in use, in addition to the water purifying apparatus of the present invention. Cold water is supplied to the mixing tap 19 through the T-tube joint 7 and a pipe 20. On the other hand, hot water is supplied to the mixing tap 19 through a hot-water angle valve 21 and a pipe 22.

Figure 2:
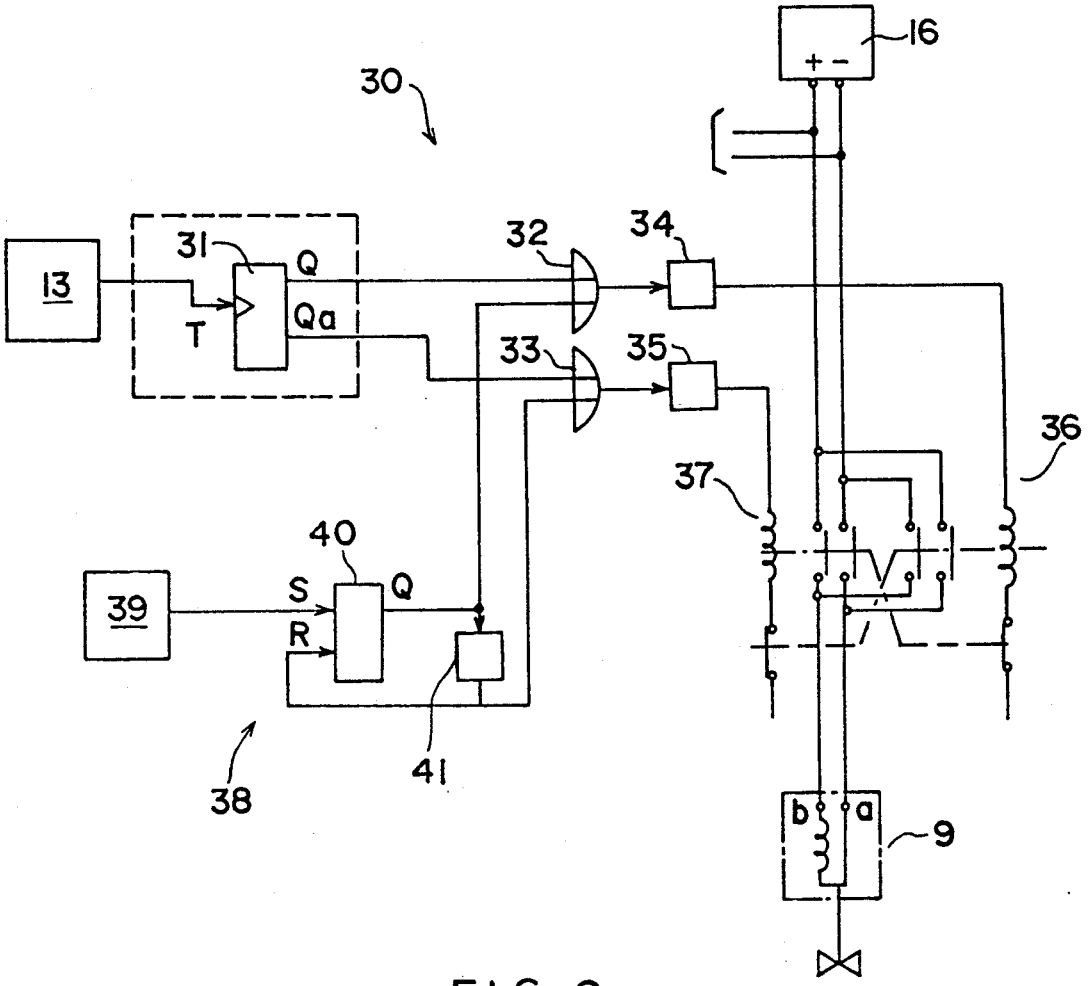
FIG. 2 is a schematic diagram of a control circuit of the water purifying apparatus of the present invention shown in FIG. 1.

FIG. 2 is a schematic diagram of the control circuit 30 used in the water purifying apparatus of the present invention. In FIG. 2, the battery power pack 16 is constructed of a plurality of dry batteries which are connected with each other in series, parallel, or both depending on needs. The battery power pack 16 supplies electric current to the solenoid valve 9, object sensor 13 and the control circuit 30.

In operation, when the object sensor 13, which has its sensor window 14 (shown in FIG. 1) formed in its side wall, senses an object, the sensor 13 issues a detection signal to an input terminal T of a T flip-flop 31 an output signal (Q, Qa) of which is reversed in level each time the detection signal is received at the input terminal T. The T flip-flop 31 has its output terminals Q and Qa connected with OR gates 32 and 33, respectively. On the other hand, the OR gates 32 and 33 have their output terminals connected with monostable multivibrators such as pulse-converting or pulse-narrowing circuits 34 and 35, respectively. In each of the pulse-narrowing circuits 34 and 35, a continuous signal or a relatively long duration pulse signal is converted to a short-duration pulse signal having a duration of, for example from several tens to several hundreds of milliseconds. The pulse-narrowing circuits 34 and 35 issue their output signals to solenoids of a high-speed relays 36 and 37, respectively.

Each of the high-speed relays 36, 37 is provided with: a pair of ON switches each of which is put into the ON position when electric current is supplied to a solenoid of the high-speed relay; and an OFF switch which is put into the OFF position when electric current is supplied to the solenoid of the high-speed relay. The OFF switch of one of the high-speed relays 36, 37 is connected in series with the solenoid of the other of the high-speed relays 36, 37 so that the relays 36, 37 are interlocked with each other. In operation, when both of the ON switches of the high-speed relay 36 are put into the ON positions, electric current supplied from the battery power pack 16 passes through the solenoid of the self-holding type solenoid valve 9 via its terminals "a" and "b" in this order, so that the valve 9 is opened. On the other hand, when both of the ON switches of the high-speed relay 37 are put into the ON positions, electric current supplied from the battery power pack 16 passes through the solenoid of the self-holding type solenoid valve 9 via its terminals "b" and "a" in this order, so that the valve 9 is closed.

A timer means 38 used in the control circuit 30 shown in FIG. 2 is constructed of a clock means 39, a set-reset type (i.e., SR type) flip-flop 40 and a timer 41. In operation, the clock means 39 repeatedly issues clock pulses at predetermined intervals. An output terminal of the clock means 39 is connected with a set (i.e., S) terminal of the SR flip-flop 40 which in turn has its output terminal Q connected with both of an input terminal of the timer 41 and an input terminal of the OR gate 32.

Now, operation of the control circuit 30 shown in FIG. 2 will be described in detail.

Figure 4:
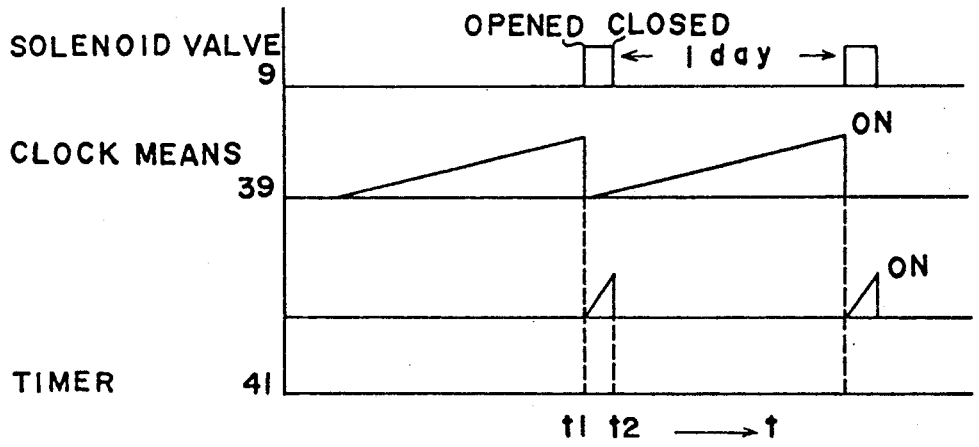
FIG. 4 is a timing chart of the control circuit shown in FIG. 2.

In an initial condition of the solenoid valve 9, the valve is closed to stop the discharge of the purified water from the water purifier (shown in FIG. 4). When the user's hand is near the sensor window 14 of the object sensor 13 shown in FIG. 1, the detection signal issued from the sensor 13 becomes one in a high level (hereinafter referred to as the H level), so that an output signal issued from the terminal Q and that issued from the terminal Qa of the T flip-flop 31 become one in the H level and one in a low level (hereinafter referred to as the L level), respectively. This condition of the T flip-flop remains as it is even when the detection signal issued from the object sensor 13 becomes one in the L level. When the output signal issued from the terminal Q of the T flip-flop 31 becomes one in the H level, the OR gate 32 issues an output signal in the H level to the pulse-narrowing circuit 34 to have the same 34 issue a pulse having a predetermined duration to the high-speed relay 36, so that the relay 36 is driven by the pulse.

When the high-speed relay 36 is driven by the pulse issued from the pulse-narrowing circuit 34, the relay 36 permits electric current (which is supplied from the battery power pack 16) to pass through the solenoid of the self-holding solenoid valve 9 via its terminals "a" and "b" in this order to cause the valve 9 to open. Under such circumstances, the self-holding type solenoid valve 9 remains opened even when the supply of the electric current to the solenoid of the valve 9 is shut off, so that the valve 9 permits the continuous discharge of the purified water from the water-tap portion 12 (shown in FIG. 1)

After that, when the user's hand is near the sensor window 14 of the object sensor 13 again, the output signal issued from the sensor 13 becomes one in the H level again to have the T flip-flop 31 reverse its output signals in level, i.e., the output signal issued from the terminal Qa of the T flip-flop 31 becomes one in the H level and that issued from the terminal Q of the same flip-flop 31 becomes one in the L level. The output signal in the H level issued from the terminal Qa of the T flip-flop 31 eventually drives the high-speed relay 37 through the OR gate 33 and the pulse-narrowing circuit 35, so that the relay 37 permits electric current (which is supplied from the battery power pack 16) to pass through the solenoid of the self-holding type solenoid valve 9 via its terminals "b" and "a" in this order for a predetermined period of time to close the valve 9. Under such circumstances, the self-holding type solenoid valve 9 remains closed even when the electric current supplied from the battery power pack 16 is shut off, so that the discharge of the purified water from the water-tap portion 12 is continuously stopped by the valve 9.

Figure 3:
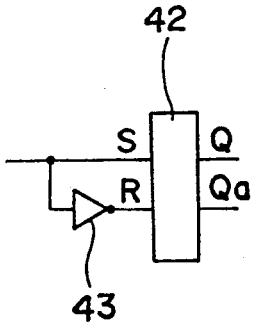
FIG. 3 is a circuit diagram of a set-reset flip-flop (hereinafter referred to as the SR flip-flop) with which a T flip-flop used in the control circuit shown in FIG. 2 is replaced.

As described above, in case that the water purifying apparatus of the present invention is of the above set/reset type, the apparatus alternately permits and prevents the discharge of the purified water from the water-tap portion 12 each time the object sensor 13 issues the detection signal or pulse. Incidentally, it is also possible to modify the water purifying apparatus of the set/rest type to one of a reaction type by slightly modifying the control circuit 30 of the apparatus. In operation, the water purifying apparatus of this reaction type permits the discharge of the purified water from the water-tap portion 12 as long as the object sensor 13 senses the presence of the object. For example, it is possible to realize such modification of the apparatus to one of the reaction type only by: forming the sensor window 14*a* in a front surface of the object sensor 13 as shown in dotted line in FIG. 1; and using (in place of the T flip-flop 31 shown in FIG. 2) a circuit shown in FIG. 3 in which a set-reset (i.e., SR) flip-flop 42 is combined with a NOT gate 43. In operation, in the apparatus of the reaction type having the above construction, when the object is near the object sensor 13, the sensor 13 issues a detection signal in the H level to a terminal S of the SR flip-flop 42 as long as the sensor 13 senses the presence of the object, so that an output signal issued from a terminal Q of the SR flip-flop 42 and that issued from a terminal Qa of the same flip-flop 42 become one in the H level and one in the L level, respectively. In contrast with the above, when no object is near the object sensor 13, the output signal issued from the terminal Qa of the SR flip-flop 42 and that issued from the terminal Q of the same flip-flop 42 become one in the H level and one in the L level, respectively. The operation performed by the above modified part of the control circuit 30 is followed by the same operation as that performed by the remaining part of the control circuit 30.

Incidentally, in the above description of the water purifying apparatus of the present invention, the contactless type object sensor is mounted on the water-tap portion of the apparatus. However, it is also possible to use a contact type mechanical switch such as a mechanical foot-operated switch in place of the contactless type object sensor. In this case, in operation, the switch is mechanically operated by the user to issue on/off signals to a suitable control circuit in which the on/off signals are converted into pulses in the H/L levels. The thus converted pulses in the H/L levels are supplied to the flip-flop.

Now, operation of the timer means 38 used in the control circuit 30 shown in FIG. 2 will be described with reference to a timing chart shown in FIG. 4.

In operation, a starting time $t_1$ of the clock means 39 is set slightly before a time when the user begins to use the water purifying apparatus, every day. For example, in case that the use of the apparatus begins at six o'clock, the starting time $t_1$ of the clock means 39 is set at ten minutes before six so as to have the means 39 issue a clock pulse at the time $t_1$ to the terminal S of the SR flip-flop 40, so that the flip-flop 40 is set. As a result, the output signal issued from the terminal Q of the SR flip-flop 40 becomes one in the H level, and is then supplied to the high-speed relay 36 through the OR gate 32 and the pulse-narrowing circuit 34 to drive the relay 36 which in turn operates the solenoid valve 9 to be opened, whereby the purified water is discharged from the water-tap portion 12 of the apparatus. On the other hand, when the output signal issued from the terminal Q of the SR flip-flop 40 becomes one in the H level as described above, operation of the timer 41 starts so that, at a time $t_2$ after a lapse of a predetermined short period of time $t_2$-$t_1$ (set by the timer 41), the timer 41 is setup to issue a pulse to the terminal R of the T flip-flop 40 to reset the flip-flop 40. As a result, the solenoid valve 9 is closed. In function, the timer 41 sets the predetermined short period of time $t_2$-$t_1$ for which the water-tap portion 12 of the apparatus discharges a predetermined amount of the purified water, which amount is slightly larger than that of the purified water confined in the water purifier 5 (shown in FIG. 1). As is clear from the timing chart of FIG. 4, the above cycle of operation is repeated every morning according to the timing defined or set by the clock means 39.

As described above, by permitting such short-time discharge of the purified water (confined in the water purifier 5) at predetermined time intervals, it is possible for the water purifying apparatus of the present invention to considerably delay bacterial development in the purified water confined in the water purifier 5. It is also possible to considerably delay bacterial development in the purified water by permitting such short-time discharge of the purified water every day at a time slightly before a time when the user begins to use the water purifying apparatus.

Figure 5:
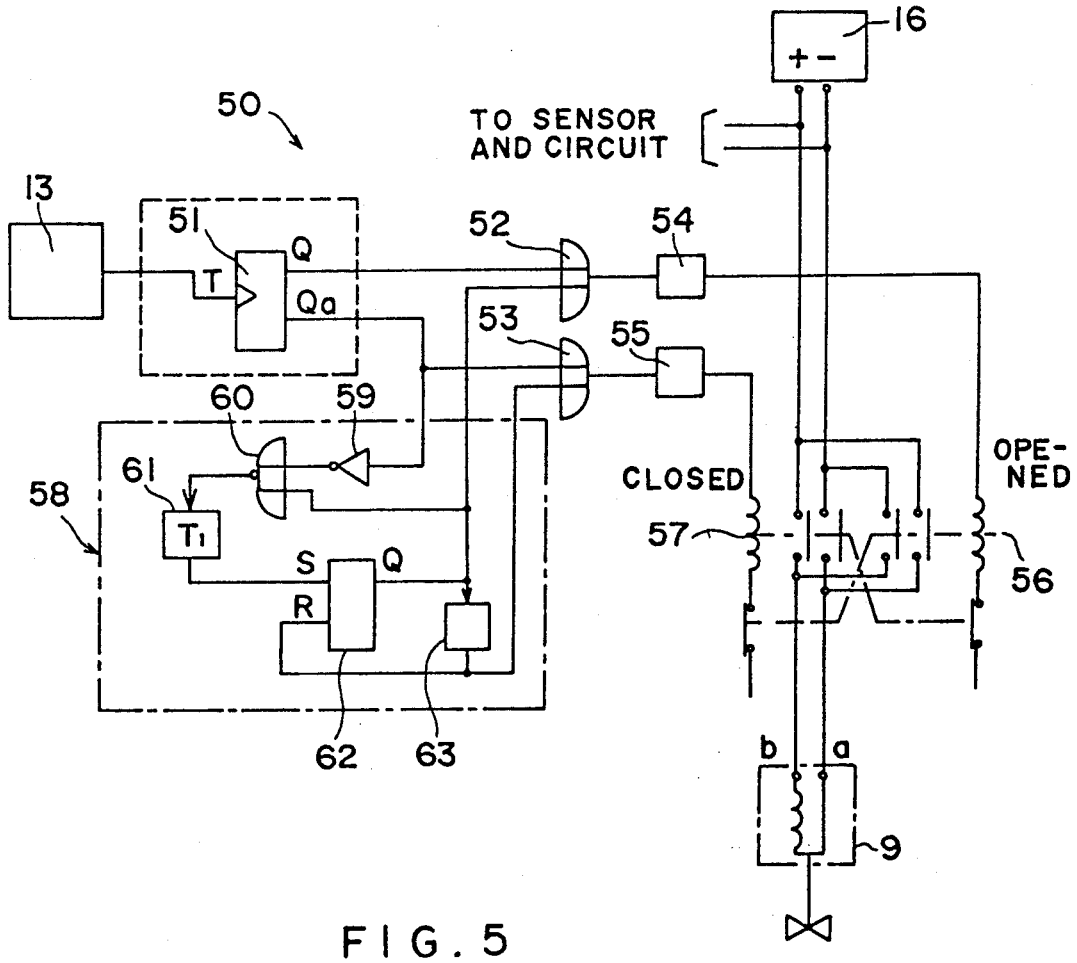
FIG. 5 is a schematic diagram of a circuit modification of the control circuit of the water purifying apparatus of the present invention shown in FIG. 1.

FIG. 5 is a schematic diagram of a circuit modification 50 of the control circuit 30 of the water purifying apparatus shown in FIG. 1. In the drawings, like reference numerals denote like parts, i.e., the reference numeral 16 denotes the battery power pack for supplying electric power to the solenoid valve 9, object sensor 13 and the control circuit 50.

As shown in FIG. 5, an output terminal of the object sensor 13, which issues the detection signal, is connected with the input terminal T of the T flip-flop 51 having its output signals reversed in level each time the detection signal issued from the sensor 13 is received therein. The T flip-flop 51 has its output terminals Q and Qa connected with OR gates 52 and 53, respectively. An output terminal of the OR gate 52 is connected with a solenoid of a high-speed relay 56 through a pulse-narrowing circuit 54 such as a monostable multivibrator. On the other hand, an output terminal of the OR gate 53 is connected with a solenoid of a high-speed relay 57 through a pulse-narrowing circuit 55 such as a monostable multivibrator. Each of the high-speed relays 56, 57 has the same construction as that of each of the high-speed relays 36, 37 shown in FIG. 2. These relays 56, 57 are connected with the self-holding type solenoid valve 9 having the same construction as that of the valve shown in FIG. 2.

In the circuit modification or control circuit 50 shown in FIG. 5, a timer means 58 is in an area shown in one-dotted chain line. In the control circuit 50, the output terminal Qa of the T flip-flop 51 is connected with an input terminal of a NOT gate 59 of the timer means 58. An output terminal of the NOT gate 59 is connected with an input terminal of a timer 61 through a NOR gate 60. An output terminal of the timer 61 is connected with a terminal S of an SR flip-flop 62. This flip-flop 62 has its output terminal connected with: the other input terminal of the OR gate 52; an input terminal of a timer 63; and an input terminal of the NOR gate 60. On the other hand, an output terminal of the timer 63 is connected with: an input terminal of an OR gate 53; and a terminal R of the SR flip-flop 62.

Now, operation of the control circuit 50 shown in FIG. 5 will be described with reference to a timing chart shown in FIG. 6.

Figure 6:
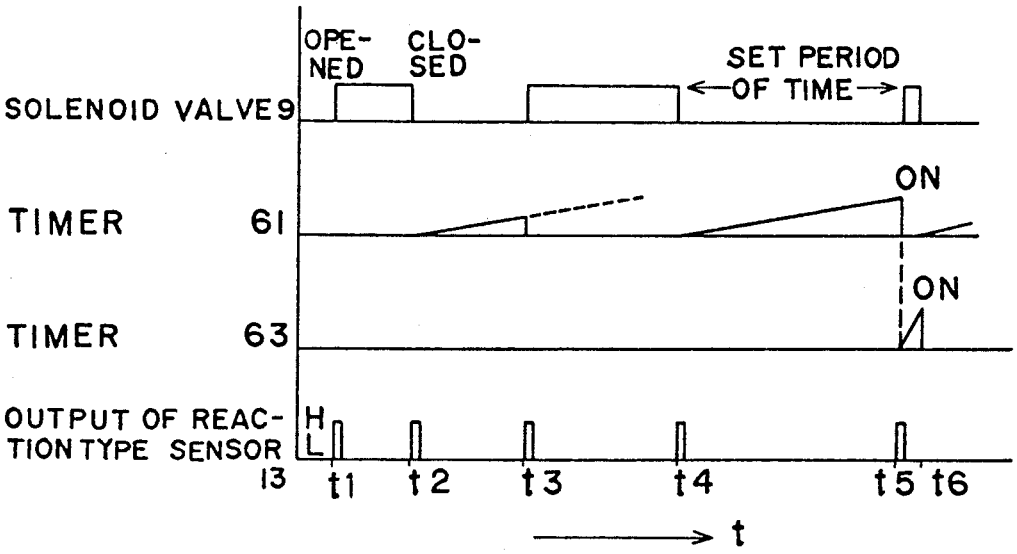
FIG. 6 is a timing chart of the circuit modification shown in FIG. 5.

As shown in FIG. 6, before a time $t_1$, the self-holding type solenoid valve 9 remains closed to stop the discharge of the purified water from the water-tap portion 12 (shown in FIG. 1). When the object sensor 13 senses or detects the object at the time $t_1$, the sensor 13 issues the detection signal to the terminal T of the T flip-flop 51 so that an output signal issued from the terminal Q of the flip-flop 51 becomes one in the H level, whereby an output signal issued from an OR gate 52 becomes one in the H level. As a result, by such H-level output signal issued from the OR gate 52, a pulse-narrowing circuit 54 and a high-speed relay 56 are sequentially driven so as to open the solenoid valve 9.

After that, when the object sensor 13 senses the object again at a time $t_2$, the output signals or pulses issued from the terminal Qa of the T flip-flop 51 and from the OR gate 53 becomes ones in the H level so that the pulse-narrowing circuit 55 and the high-speed relay 57 are sequentially driven by the pulses, whereby the high-speed relay 57 operates the solenoid valve 9 so as to close the valve 9. As described above, in the water purifying apparatus of set/reset type, the discharge of the purified water is alternately prevented and permitted each time the object sensor 13 issues the detection signal. Incidentally, as described above with reference to the control circuit 30 shown in FIG. 2, it is also possible to convert the set/reset type water purifying apparatus (which uses the T flip-flop 51) into a reaction type apparatus by replacing the T flip-flop 51 with the circuit shown in FIG. 3.

On the other hand, when the output signal issued from the terminal Qa of the T flip-flop 51 becomes one in the H level, an output signal issued from the NOT gate 59 of the timer means 58 becomes one in the L level, and that issued from the NOR gate 60 becomes one in the H level. As a result, the timer 61 begins to start. The timer 61 is used for stopping the discharge of the purified water from the water-tap portion 12 (shown in FIG. 1) for a predetermined period of time. When the object sensor 13 senses the object at a time $t_3$ before a lapse of such predetermined period of time set by the timer 61, the detection signal (issued from the sensor 13) is supplied to the terminal T of the T flip-flop 51 to cause the flip-flop 51 to issue a reversed output signal from its output terminal Qa, the reversed output signal being in the H level. As a result, the timer 61 is returned to its original starting point again.

Then, after the discharge of the purified water from the water-tap portion 12 (shown in FIG. 1) is stopped again for a period of time $t_2$-$t_1$, the timer 61 is set up to issue a pulse signal in the H level at the time $t_5$ to the terminal S of the SR flip-flop 62 to set the flip-flop 62. As a result, the output signal issued from the terminal Q of the SR flip-flop becomes one in the H level and is supplied to the OR gate 52 to have the same 52 issue an output signal in the H level, so that the solenoid valve 9 is operated to be opened, whereby the discharge of the purified water from the water-tap portion 12 (shown in FIG. 1) starts. On the other hand, when the output signal issued from the terminal Q of the SR flip-flop 62 becomes one on the H level, the output signal issued from the NOR gate 60 becomes one in the L level so that the timer 61 returns to its starting point. However, in contrast with the timer 61, the SR flip-flop 62 remains as it is.

In operation, when the output signal issued from the terminal Q of the SR flip-flop 62 becomes one in the H level, another timer 63 begins to start. Then, after lapse of a predetermined period of time set by the another timer 63, the another timer 63 is set up to issue a signal pulse at a time $t_6$ to the terminal R of the SR flip-flop 62 to reset the flip-flop 62. At the same time, the signal pulse issued from the another timer 63 is supplied to the OR gate 53 to have the same 53 issue an output signal in the H level, so that the solenoid valve 9 is closed by the signal pulse passing through the pulse-narrowing circuit 55 and the high-speed relay 57, whereby the discharge of the purified water from the water-tap portion 12 (shown in FIG. 1) is stopped. The another timer 63 is used for permitting the discharge of the purified water from the water-tap portion 12 for a predetermined short time in order to discharge a predetermined amount of the purified water from the water purifier 5 (shown in FIG. 1), which predetermined amount of the purified water is slightly larger than that of the purified water confined in the water purifier 5 (shown in FIG. 1).

Such short-time discharge of the purified water is repeatedly performed until the object sensor 13 issues a detection signal, so that bacterial development in the purified water confined in the water purifier 5 (shown in FIG. 1) is considerably delayed.

Figure 7:
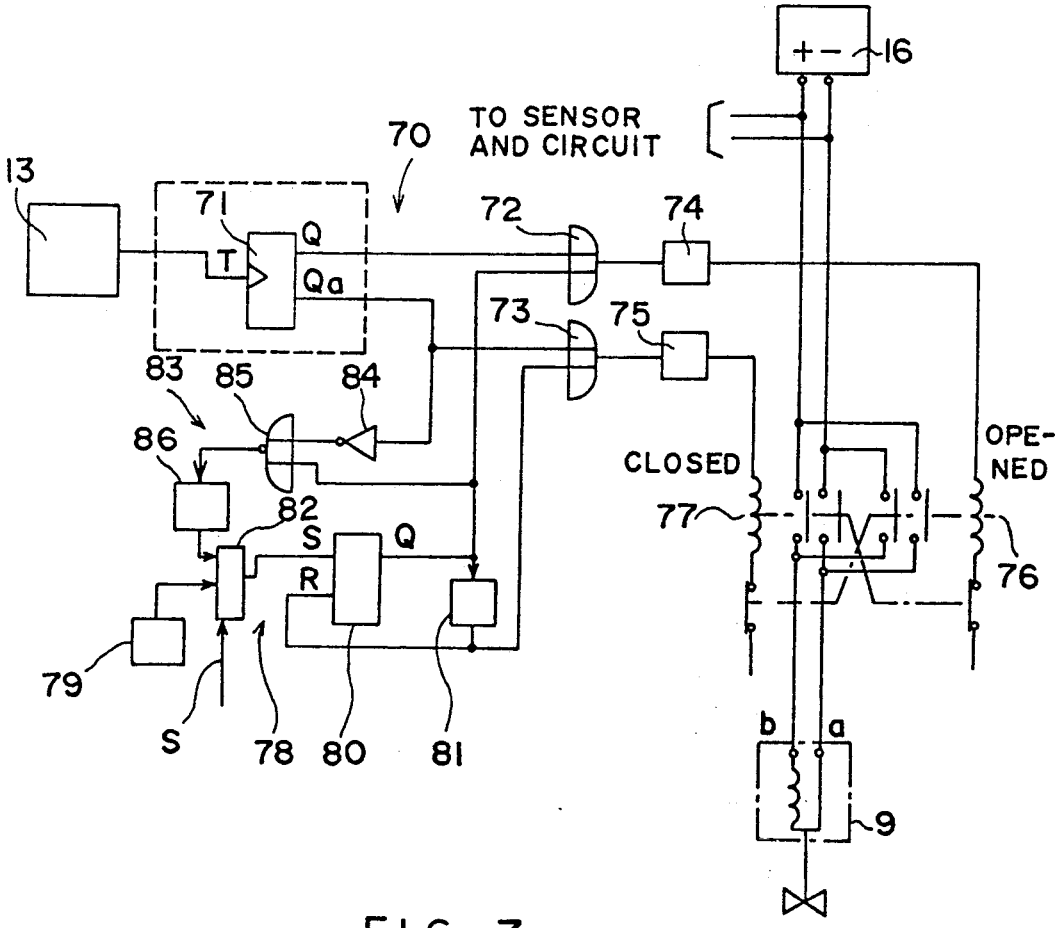
FIG. 7 is a schematic diagram of another circuit modification of the control circuit of the water purifying apparatus of the present invention shown in FIG. 1.

FIG. 7 is a schematic diagram of another circuit modification 70 of the control circuit 30 (shown in FIG. 1) of the water purifying apparatus of the present invention. In operation of the another circuit modification or control circuit 70 shown in FIG. 7, means corresponding to both of the timer means 38 (shown in FIG. 2) and the timer means 58 (shown in FIG. 5) are selectively used. As is clear from FIG. 7, the battery power pack 16 supplies electric power to the self-holding type solenoid valve 9, object sensor 13 and the control circuit 70.

In operation, the output signal or detection signal issued from the object sensor 13 is supplied to an input terminal T of a T flip-flop 71 which reverses its output signals in level each time the detection signal is received therein. The T flip-flop 71 has its output terminals Q and Qa connected with OR gates 72 and 73, respectively. An output terminal of the OR gate 72 is connected with a solenoid of a high-speed relay 76 through a pulse-narrowing circuit 74 such as a monostable multivibrator. On the other hand, an output terminal of the OR gate 73 is connected with a solenoid of a high-speed relay 77 through a pulse-narrowing circuit 75 such as a monostable multivibrator. Incidentally, each of the high-speed relays 76, 77 and the self-holding type solenoid valve 9 is the same in construction as each of corresponding circuit components shown in FIG. 2.

In the control circuit 70 shown in FIG. 7, a timer means 78 corresponds to the timer means 38 shown in FIG. 2, and is constructed of a clock means 79, a set-reset (i.e., SR) flip-flop 80 and a timer 81. In operation, the clock means 79 repeatedly issues clock pulses at predetermined time intervals. An output terminal of the clock means 79 is connected with an input terminal S of the SR flip-flop 80 through a multiplexer 82 which switches connection with the SR flip-flop 80 upon receipt of an instruction signal S'. On the other hand, an output terminal Q of the SR flip-flop 80 is connected with: an input terminal of the timer 81; and an input terminal of an OR gate 72.

A timer means 83 shown in FIG. 7 corresponds to the timer means 58 shown in FIG. 5. In the control circuit 70, an output terminal Qa of the T flip-flop 71 is connected with a NOT gate 84 of the timer means 83. On the other hand, an output terminal of the NOT gate 84 is connected with an input terminal of a NOR gate 85 which has its output terminal connected with an input terminal of another timer 86. An output terminal of the another timer 86 is connected with the input terminal S of the SR flip-flop 80 through the multiplexer 82. The output terminal Q of the SR flip-flop 80 is connected with: the input terminal of the OR gate 72; the input terminal of the timer 81; and the input terminal of the NOR gate 85. The output terminal of the timer 81 is connected with: an input terminal of another OR gate 73; and an input terminal R of the SR flip-flop 80.

Figure 8:
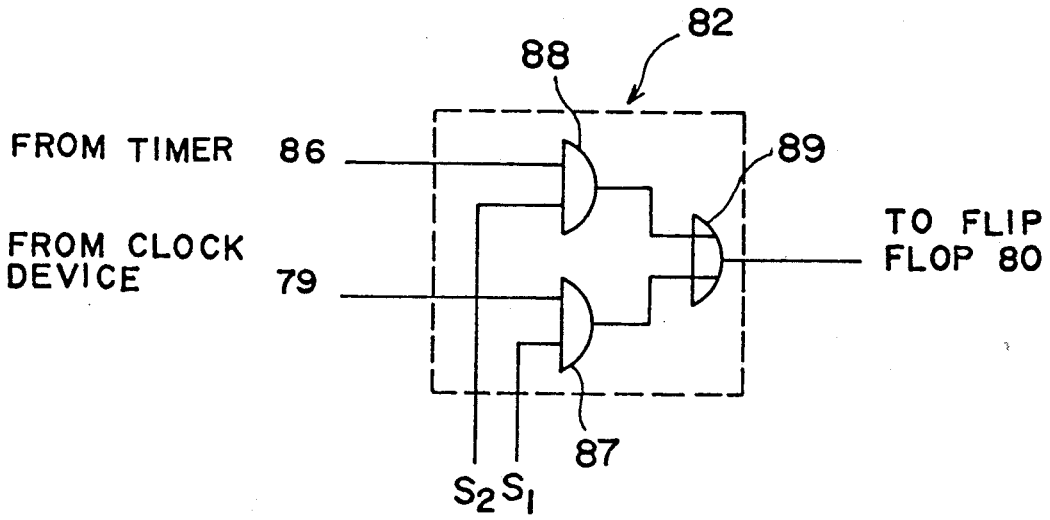
FIG. 8 is a schematic diagram of a multiplexer used in the another circuit modification shown in FIG. 7.

FIG. 8 is a schematic diagram of the multiplexer 82 which is constructed of: a pair of AND gates 87, 88; and an OR gate 89 having its input terminals connected with an output terminal of each of the AND gates 87, 88. The AND gate 87 has: one of a pair of its input terminals connected with an output terminal of the clock means 79; and the other of the pair of its input terminals connected with a terminal issuing a selection-instruction signals $S_1$ for selecting the timer means 78 in operation. On the other hand, the remaining AND gate 88 has: one of a pair of its input terminals connected with an output terminal of the another timer 86; and the other of the pair of its input terminals connected with a terminal issuing a selection-instruction signals $S_2$ for selecting the timer means 83 in operation.

In the control circuit 70 shown in FIG. 7, the SR flip-flop 80 and the timer 81 are shared in operation by the timer means 78, 83. In place of the above construction, it is also possible to provide both of the SR flip-flop 80 and the timer 81 in each of the timer means 78, 83. In this case, i.e., in case that the SR flip-flop 80 and the timer 81 are not shared in operation by the timer means 78, 83, it is possible to eliminate the multiplexer 82. In addition, in the control circuit 70 shown in FIG. 7, by using the circuit shown in FIG. 3 in place of the T flip-flop 71, it is possible to convert the water purifying apparatus of the set/reset type of the present invention into one of the reaction type.

Since there is substantially no difference in operation between: the control circuit 70; and each of the control circuits 30 and 50 respectively shown in FIGS. 2 and 5, operation of the control circuit 70 is not described here to avoid redundancy in description.

As described above, since it is possible for the water purifying apparatus of the present invention to considerably delay bacterial development in the purified water confined in the apparatus, the apparatus of the present invention meets any sanitary requirements.

Further, in case that the water purifying apparatus of the present invention is installed in the kitchen, any additional wiring work is not required in installation thereof so that the installation of the apparatus is considerably facilitated.

In addition, since the apparatus of the present invention uses a battery power pack as its electric power source, there is no fear that the user can not use the apparatus even when a commercial power supply is interrupted by accident.

Further, the user using the apparatus of the present invention is safe from any electric shock in spite of a wet operational condition (around the sink) in which the apparatus is used.

Still further, since the apparatus of the present invention uses the self-holding type solenoid valve the power consumption of which is extremely low, it is possible for the apparatus of the present invention to enjoy a long service life even when the apparatus uses the battery power pack as its power source.

What is claimed is:

1. A water purifying apparatus having an under-sink type water purifier comprising:

a water-tap portion connected to a purified-water outlet of said water purifier to discharge purified water from said water purifier;

an object sensor arranged for sensing an object and in response issuing detection signals upon sensing object to initiate the starting and the stopping of the discharge of said purified water from said water purifier;

a solenoid valve arranged for starting and stopping the discharge of said purified water from said water-tap portion in response to said detection signal issued from said object sensor; and a control circuit arranged for opening and closing said solenoid valve in response to issuance of one of said detection signals issued from said object sensor, said control circuit being provided with a timer means for initiating the opening of said solenoid valve, after completion of, a preset time interval, for a short time and arranged such that said present time interval is interrupted and said timer means is reset to begin a new interval in response to a new detection signal being issued.

2. A water purifying apparatus having an under-sink type water purifier comprising:

a water-tap portion connected to a purified-water outlet of said water purifier to discharge purified water from said water purifier;

an object sensor arranged for sensing an object and in response issuing detection signals upon sensing said object to initiate the starting and the stopping of the discharge of said purified water from said water purifier;

a solenoid valve arranged for starting and stopping the discharge of said purified water from said water-tap portion in response to said detection signals issued from said object sensor; and a control circuit arranged for opening and closing said solenoid valve in response to issuance of one of said detection signals issued from said object sensor, said control circuit being provided with a timer means for opening said solenoid valve for a short time to permit said water-tap portion to discharge said purified water therefrom in response to passage of any predetermined period of time of water being confined between said water purifier and said purified water outlet.

3. The water purifying apparatus as set forth in one of claims 1 and 2, wherein:

said object sensor is constructed of a foot-operated switch provided in a vicinity of a floor near a cabinet disposed under said sink.

4. The water purifying apparatus as set forth in claim 2, wherein:

a battery power pack is used as a power supply for supplying electric current to said control circuit, said object sensor, said solenoid valve and said timer means.

5. The water purifying apparatus as set forth in claim 4, wherein:

said solenoid valve is a latching type solenoid valve.

6. The water purifying apparatus as set forth in claim 2, wherein:

said object sensor is of a set/reset type, so that said solenoid valve is alternately opened and closed in response to every detection signal issued from said object sensor, whereby said solenoid valve alternately permits and prevents the discharge of said purified water from said water-tap portion each time said object sensor senses an object to issue said detection signal.

7. The water purifying apparatus as set forth in claim 2, wherein:

said object sensor is of a reaction type, so that said solenoid valve is opened to permit said water-tap portion to discharge said purified water therefrom as long as said object is near said object sensor and sensed thereby.

8. The water purifying apparatus as set forth in claim 7, wherein said under-sink type water purifier is installed in a cabinet under said sink;

said object sensor is provided in said water-tap portion which is disposed over said sink; and a sensible window of said object sensor is formed in a side surface of said object sensor, which side surface extends at right angles to a front surface of said water-tap portion, said front surface being oppositely disposed from a user placing himself in front of said sink.

9. A water purifying apparatus having an under-sink type water purifier comprising:

a water-tap portion connected to a purified-water outlet of said water purifier to discharge purified water from said water purifier;

an object sensor arranged for sensing an object and in response issuing detection signals upon sensing said object to initiate the starting and the stopping of the discharge of said purified water from said water purifier;

a solenoid valve arranged for starting and stopping the discharge of said purified water from said water-tap portion in response to said detection signal issued from said object sensor;

a control circuit arranged for opening and closing said solenoid valve in response to issuance of one of said detection signals issued from said object sensor said control circuit being provided with a first timer means for opening said solenoid valve at a preset time for a short time, and second timer means for opening said solenoid valve for a short time to permit said water-tap portion to discharge said purified water therefrom in response to passage of any predetermined period of time of water being confined between said water purifier and said purified water outlet;

and wherein:

said object sensor is of a set/reset type, so that said solenoid valve is alternately opened and closed in response to detection signals issued from said object sensor, whereby said solenoid valve alternately permits and prevents the discharge of said purified water from said water-tap portion each time said object sensor senses said object to issue said detection signal, and wherein said under-sink type water purifier is installed in a cabinet under said sink;

said object sensor is provided in said water-tap portion which is adapted to be disposed over said sink; and a sensible window of said object sensor is formed in a front surface of said object sensor, said front surface being oppositely disposed from a user placing himself in front of said sink.

* * * * *